US010527991B2

(12) United States Patent
Sugata

(10) Patent No.: US 10,527,991 B2
(45) Date of Patent: Jan. 7, 2020

(54) PRINTING APPARATUS, PRINTING SYSTEM, AND NON-TRANSITORY COMPUTER READABLE MEDIUM FOR PRINTING

(71) Applicant: FUJI XEROX CO., LTD., Tokyo (JP)

(72) Inventor: Tomokazu Sugata, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/997,759

(22) Filed: Jun. 5, 2018

(65) Prior Publication Data

US 2019/0196379 A1 Jun. 27, 2019

(30) Foreign Application Priority Data

Dec. 25, 2017 (JP) ..... 2017-247871

(51) Int. Cl.
*G03G 15/00* (2006.01)

(52) U.S. Cl.
CPC ..... *G03G 15/5058* (2013.01); *G03G 2215/00569* (2013.01)

(58) Field of Classification Search
CPC ..... G03G 15/5058; G03G 15/5062; G03G 2215/00569
See application file for complete search history.

(56) References Cited

U.S. PATENT DOCUMENTS

2014/0186076 A1* 7/2014 Murayama ..... G03G 15/0189 399/301

FOREIGN PATENT DOCUMENTS

JP 2006-187909 7/2006

OTHER PUBLICATIONS

Abstract and machine translation of JP 2006-187909.

* cited by examiner

*Primary Examiner* — Hoang X Ngo
(74) *Attorney, Agent, or Firm* — Fildes & Outland, P.C.

(57) ABSTRACT

There is provided a printing apparatus. The printing apparatus includes: a memory storing a program; and at least one hardware processor configured to execute a process in the program. The process includes: performing pre-printing of overprinting which is an operation of performing pre-printing on a medium and then performing post-printing on the medium; and printing a chart asymmetric with respect to rotation toward a direction of the medium on the medium during test printing related to the pre-printing.

18 Claims, 12 Drawing Sheets

FIG. 12

NORMALITY/ABNORMALITY DETERMINATION

| | NORMAL PATTERN | | POST-PRINTING DIRECTION ABNORMALITY PATTERN | | DETECTION FAILURE PATTERN | |
|---|---|---|---|---|---|---|
| | SEARCH AREA | DETECTION RESULT | SEARCH AREA | DETECTION RESULT | SEARCH AREA | DETECTION RESULT |
| | F1 | ○ (DETECTED) | F1 | ○ (DETECTED) | F1 | ○ (DETECTED) |
| | F2 | ○ (DETECTED) | F2 | × (NOT DETECTED) | F2 | ○ (DETECTED) |
| | F3 | ○ (DETECTED) | F3 | ○ (DETECTED) | F3 | ○ (DETECTED) |
| | F4 | ○ (DETECTED) | F4 | ○ (DETECTED) | F4 | × (NOT DETECTED) |
| | F5 | ○ (DETECTED) | F5 | × (NOT DETECTED) | F5 | ○ (DETECTED) |
| | F6 | ○ (DETECTED) | F6 | ○ (DETECTED) | F6 | ○ (DETECTED) |
| (FOR DIRECTION DETERMINATION) | F7 | × (NOT DETECTED) | F7 | ○ (DETECTED) | F7 | × (NOT DETECTED) |
| (FOR DIRECTION DETERMINATION) | F8 | × (NOT DETECTED) | F8 | × (NOT DETECTED) | F8 | × (NOT DETECTED) |

PRINTING APPARATUS, PRINTING SYSTEM, AND NON-TRANSITORY COMPUTER READABLE MEDIUM FOR PRINTING

CROSS-REFERENCE TO RELATED APPLICATIONS

This application is based on and claims priority under 35 USC 119 from Japanese Patent Application No. 2017-247871 filed on Dec. 25, 2017.

BACKGROUND

Technical Field

The present disclosure relates to a printing apparatus, a printing system, and a non-transitory computer readable medium.

SUMMARY

According to an aspect of the invention, there is provided a printing apparatus including: a memory storing a program; and at least one hardware processor configured to execute a process in the program, the process including: performing pre-printing of overprinting which is an operation of performing pre-printing on a medium and then performing post-printing on the medium; and printing a chart asymmetric with respect to rotation toward a direction of the medium on the medium during test printing related to the pre-printing.

BRIEF DESCRIPTION OF THE DRAWINGS

Exemplary embodiment(s) of the present invention will be described in detail based on the following figures, wherein:

FIG. 12 is a view illustrating specific examples related to printing-state determination.

DETAILED DESCRIPTION

Figure 1:
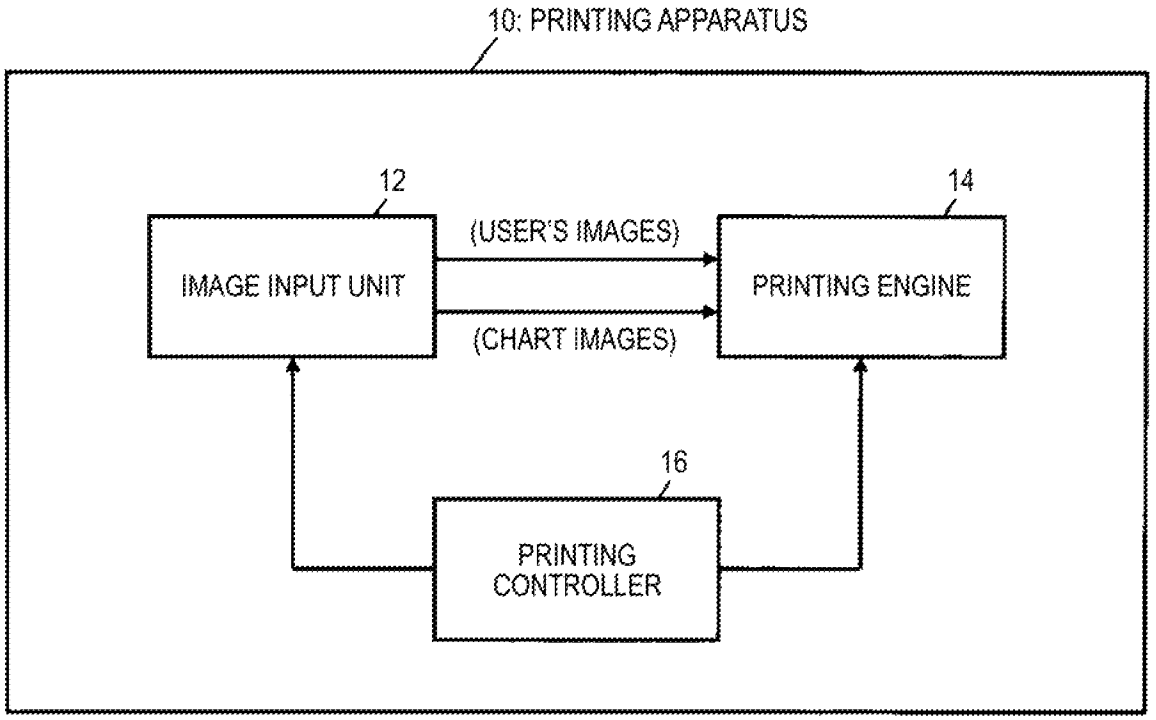
FIG. 1 is a view illustrating a specific example of a printing apparatus according to an exemplary embodiment of the present invention.

FIG. 1 is a view illustrating a specific example of a printing apparatus according to an exemplary embodiment of the present invention. In the specific example shown in FIG. 1, a printing apparatus 10 includes an image input unit 12, a printing engine 14, and a printing controller 16.

To the image input unit 12, print data to be a print object is input. Specific examples of print data are image data (including data on only characters, numbers, and symbols), and image data obtained from an external device such as a computer, or image data read by a scanner or the like can be input to the image input unit 12.

The image input unit 12 outputs, for example, image data of user's images which are print objects based on a printing instruction received from a user, to the printing engine 14. Also, the image input unit 12 outputs image data of a chart image to the printing engine 14 during test printing (to be described below).

The printing engine 14 prints the images (including images of only characters, numbers, and symbols) corresponding to the image data acquired from the image input unit 12, on media such as paper sheets. However, the printing engine 14 may print the images on media other than paper sheets, such as resin sheets, metal sheets, plates, and fabrics.

The printing controller 16 controls the image input unit 12 and the printing engine 14. The printing controller 16 controls the image input unit 12 and the printing engine 14, for example, according to user's operations received via an operation device or the like, such that user's images of images, documents, and the like are printed. Also, the printing controller 16 controls the image input unit 12 and the printing engine 14 during test printing (to be described below) such that image data on a chart image is printed. However, during test printing, a synthetic image of a chart image and a user's image may be printed.

The printing apparatus 10 shown as a specific example in FIG. 1 can be implemented, for example, with a computer. This computer has hardware resources, such as an arithmetic processing unit such as a CPU, storage devices such as a memory and a hard disk, a communication device for using a communication line such as the Internet, a device for reading data from storage media such as optical disks and semiconductor memories and writing data on storage media, a display device such as display, and an operation device for receiving user's operations.

Further, for example, a program (software) corresponding to the image input unit 12 and the printing controller 16 of FIG. 1 can be loaded into the computer, and the hardware resources included in the computer and the loaded software can cooperate with each other such that the functions of the image input unit 12 and the printing controller 16 are implemented by the computer. This program may be provided to the computer via a communication network such as the Internet, or may be stored in a storage medium such as an optical disk and be loaded from the storage medium into the computer. In this case, the printing engine 14 such as a printer may be controlled by the computer having the functions of the image input unit 12 and the printing controller 16.

The printing apparatus 10 shown as an example in FIG. 1 can be used to perform overprinting. During overprinting, first, pre-printing is performed on paper sheets which are printing subjects, and then post-printing is performed on the paper sheets subjected to the pre-printing.

In the specific example shown in FIG. 1, the printing engine 14 of the printing apparatus 10 performs pre-printing of overprinting. Thereafter, post-printing is performed by anther engine (not shown in the drawings) (a printing engine provided separately from the printing engine 14). The separate engine for performing post-printing may be provided in another apparatus (a printing apparatus provided separately from the printing apparatus 10), or the printing apparatus 10 may have the printing engine 14 and the separate engine, or the printing engine of the printing apparatus 10 may be used several times to perform post-printing.

Also, a specific example of pre-printing is normal printing such as color image printing or monochrome image printing. In the case of performing normal printing as pre-printing, the printing engine 14 is, for example, an electrophotographic full-color print engine, and prints color images or monochrome images on media such as paper sheets with color toner of four colors C, M, Y, and K which are color materials.

Meanwhile, a specific example of post-printing is special printing using metallic toner, clear toner, or the like. In the case of performing special printing as post-printing, the separate engine (not shown in the drawings) performs special printing using metallic toner, clear toner, or the like.

However, in pre-printing, special printing may be performed, and in post-printing, normal printing may be performed. Also, overprinting which is a combination different from the combination of normal printing and special printing may be implemented.

In overprinting in which pre-printing is performed and then post-printing is performed, it is desirable to perform adjustment between pre-printing and post-printing. For example, in the case of performing pre-printing by one of two engines and performing post-printing by the other, between the two printing engines, printing position adjustment (misalignment adjustment), magnification adjustment, and so on are performed.

Figure 2:
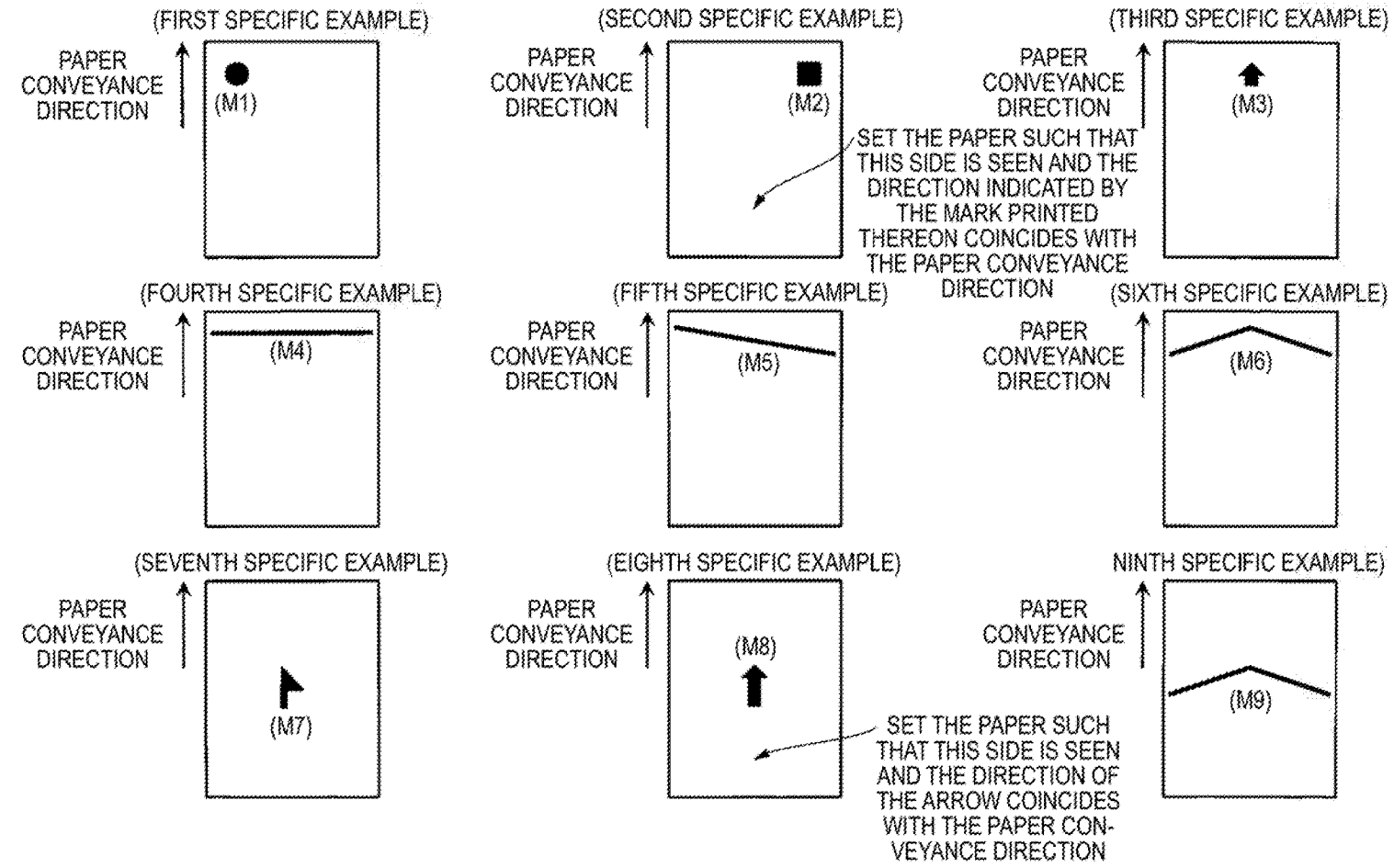
FIG. 2 is a view illustrating specific examples of a first chart including a mark indicating a sheet direction.
Figure 3:
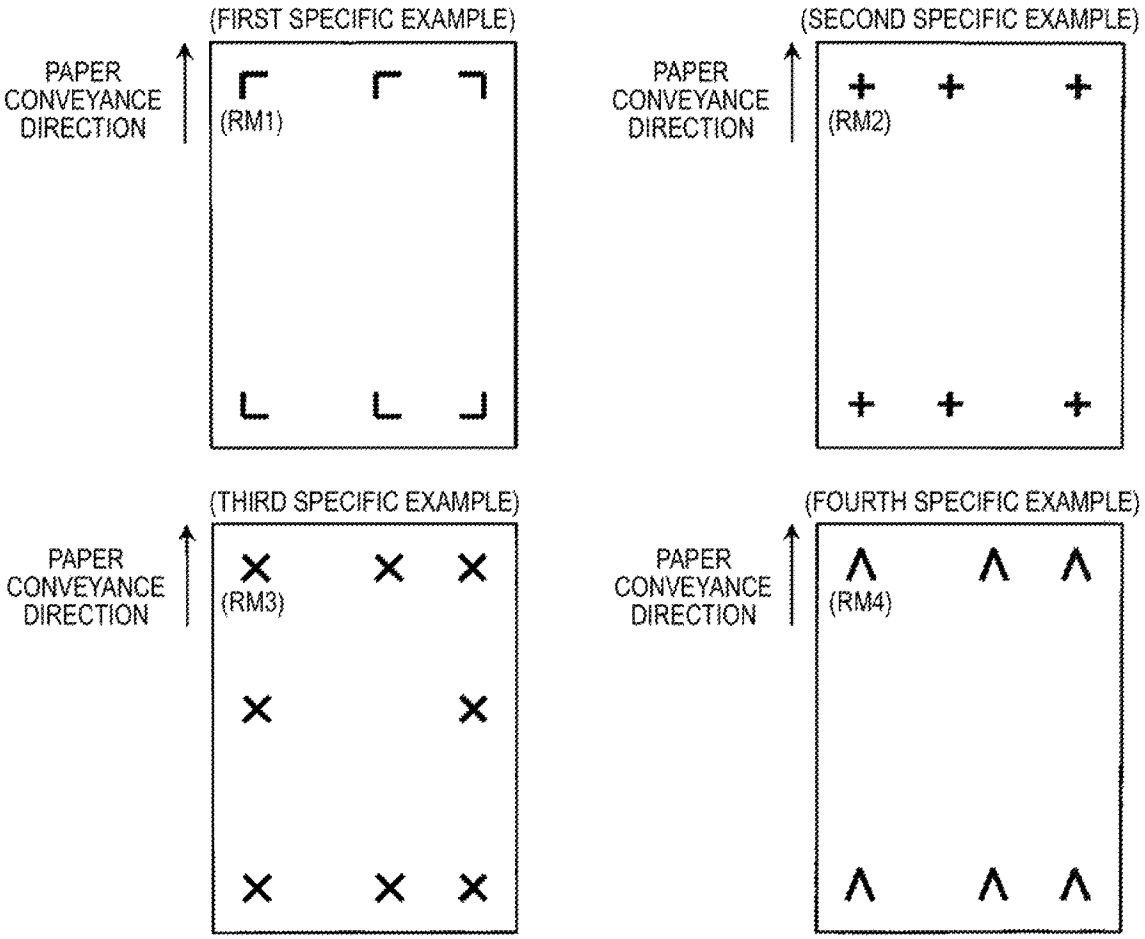
FIG. 3 is a view illustrating specific examples of a first chart including two or more reference marks.

The printing apparatus 10 shown as an example in FIG. 1 has a function of performing test printing related to pre-printing, in addition to the function of performing pre-printing of overprinting. The printing engine 14 of the printing apparatus 10 prints a first chart asymmetric with respect to rotation of a paper sheet (medium) direction, on a paper sheet (a medium), during test printing related to pre-printing. Representative specific examples of the first chart are shown in FIGS. 2 and 3. During test printing related to pre-printing, the printing engine 14 of FIG. 1 prints, for example, a first chart including one or more marks each of which indicates a paper sheet direction.

FIG. 2 is a view illustrating specific examples of a first chart including a mark indicating a paper sheet direction. FIG. 2 shows specific examples of marks having positions indicating paper sheet (medium) directions and marks having shapes indicating paper sheet (medium) directions.

In first to sixth specific examples of FIG. 2, marks M1 to M6 having positions indicating paper sheet directions (paper set directions for post-printing) are shown. Each of the marks M1 to M6 is arranged at a position asymmetric with respect to rotation of the paper sheet direction. In the first to sixth specific examples of FIG. 2, the marks M1 to M6 are arranged, for example, at positions in the leading parts of the paper sheets in the directions in which the paper sheets should be conveyed in a paper feeding unit of the printing apparatus for performing post-printing (in the vicinities of the outer edges of the leading parts of the paper sheets in the set directions).

For example, the mark M1 shown in the first specific example is circular and is arranged at a position on the left side of the leading part of the paper sheet in the direction in which the paper sheet should be conveyed, and the mark M2 shown in the second specific example is rectangular and is arranged at a position on the right side of the leading part of the paper sheet in the direction in which the paper sheet should be conveyed. However, for example, as shown in the second specific example, a message like "SET THE PAPER SUCH THAT THIS SIDE IS SEEN AND THE DIRECTION INDICATED BY THE MARK PRINTED THEREON COINCIDES WITH THE PAPER CONVEYANCE DIRECTION" may be printed in a first chart.

The mark M3 shown in the third specific example has an arrow shape and is arranged at the center on the leading part of the paper sheet in the direction in which the paper sheet should be conveyed. Also, the shape of the arrow mark M3 shown in the third specific example indicates the set direction of the paper sheet (the direction in which the paper sheet should be conveyed).

Also, for example, as shown in the fourth to sixth specific examples, the marks M4 to M6 have straight-line or broken-line shapes and may be arranged at positions in the leading parts of the paper sheets in the directions in which the paper sheets should be conveyed (in the vicinities of the leading outer edges). Further, the broken-line mark M6 shown in the sixth specific example indicates the set direction of the paper sheet (the direction in which the paper sheet should be conveyed) by its shape (its corner direction).

In seventh to ninth specific examples of FIG. 2, marks M7 to M9 indicating directions in which paper sheets should be conveyed are shown. Each of the marks M7 to M9 has a shape asymmetric with respect to rotation of the direction of the corresponding paper sheet. For example, the marks M7 and M8 shown in the seventh and eighth specific examples have arrow shapes and the directions of the arrows indicate the set directions of the paper sheets (the directions in which the paper sheets should be conveyed). Also, the mark M9 shown in the ninth specific example has a broken-line shape, and the direction of the corner thereof indicates the set direction of the paper sheet (the direction in which the paper sheet should be conveyed). Also, for example, as shown in the eighth specific example, a message like "SET THE PAPER SUCH THAT THIS SIDE IS SEEN AND THE DIRECTION OF THE ARROW COINCIDES WITH THE PAPER CONVEYANCE DIRECTION" may be printed in a first chart.

As described above, in the first to sixth specific examples of FIG. 2, the marks M1 to M6 are arranged at positions on the leading sides in the directions in which the paper sheets should be conveyed, so as to indicate the set directions of the paper sheets, and in the seventh to ninth specific examples of FIG. 2, the shapes of the marks M7 to M9 indicate the set directions of the paper sheets.

Therefore, for example, if a first chart including any one (or two or more) of the marks M1 to M9 is printed on a paper sheet, from at least one of the position and shape of the one of the marks M1 to M9, it is possible to recognize the set direction of the paper sheet (the direction in which the paper sheet should be conveyed).

For example, if a first chart including any one (or two or more) of the marks M1 to M9 is printed on a paper sheet during test printing related to pre-printing, from at least one of the position and shape of the one of the marks M1 to M9, the user can recognize the set direction of the paper sheet for test printing related to post-printing. Therefore, the user can correctly set the paper sheet for post-printing. Further, if a message indicating a paper set direction is included in a first chart, for example, as shown in the second and eighth specific examples of FIG. 2, it becomes a great deal easier to recognize the paper set direction for post-printing. Alternatively, in place of a mark, a message may indicate a paper set direction (a direction in which a paper sheet should be conveyed). Also, for example, any one (or two more) of the marks M1 to M9 may be printed on one side of the front and rear sides of a paper sheet, such that it becomes possible to distinguish between the front and rear sides of the paper sheet.

Also, the printing engine 14 of FIG. 1 may print a first chart including two or more reference marks indicating two or more reference positions for adjustment for post-printing (such as misalignment adjustment and magnification adjustment between a pre-printed image), during test printing related to pre-printing.

FIG. 3 is a view illustrating specific examples of first charts each of which includes two or more reference marks indicating two or more reference positions. In each of first to fourth specific examples of FIG. 3, reference marks RM1, RM2, RM3, or RM4 indicating reference positions are shown.

The first specific example of FIG. 3 shows the reference marks RM1 which are uncinate. For example, the corners of the uncinate reference marks RM1 indicate reference positions. In the first specific example, six reference marks RM1 indicate six reference positions. In other words, the six reference marks RM1 indicate four reference positions corresponding to four corners of a paper sheet, and two reference positions corresponding to two of the centers between the corners of the paper sheet. However, in the first specific example of FIG. 3, the two reference positions corresponding to the centers between the corners of the paper sheet are arranged so as to be slightly deviated from the centers to the right side.

Further, in the first specific example of FIG. 3, the six reference marks RM1 are arranged so as to be asymmetric with respect to rotation of the direction of the paper sheet. For example, the reference marks RM1 are arranged such that in the case of rotating the paper sheet (such rotation includes rotation of 90 degrees clockwise or counterclockwise and rotation of 180 degrees), the arrangement of the reference marks RM1 before rotation does not coincide with that after rotation.

However, image display on a display device, a description in a manual, a description on a paper tray, and the like may be used to inform the user of the arrangement and correct set direction of the six reference marks RM1 shown in the first specific example of FIG. 3.

The second specific example of FIG. 3 shows the reference marks RM2 which have a plus sign shape. For example, the intersection points of the reference marks RM2 having the plus sign shape indicate reference positions. Even in the second specific example of FIG. 3, six reference marks RM2 are arranged so as to be asymmetric with respect to rotation of the direction of the paper sheet, and indicate four reference positions corresponding to four corners of the paper sheet, and two reference positions corresponding to two of the centers between the corners of the paper sheet. However, in the second specific example of FIG. 3, the two reference positions corresponding to the centers between the corners of the paper sheet are arranged so as to be slightly deviated from the centers to the left side.

The third specific example of FIG. 3 shows the reference marks RM3 which have an X shape. For example, the intersection points of the reference marks RM3 having the X shape indicate reference positions. In the third specific example of FIG. 3, eight reference marks RM3 are arranged so as to be asymmetric with respect to rotation of the direction of the paper sheet, and indicate four reference positions corresponding to four corners of the paper sheet, and four reference positions corresponding to the centers between the corners of the paper sheet.

The fourth specific example of FIG. 3 shows the reference marks RM4 which have an inverted V shape. For example, the corner (the intersection point of two line segments) of each of the reference marks RM4 having the inverted V shape indicates a reference position. Similarly to the first specific example of FIG. 3, even in the fourth specific example of FIG. 3, six reference marks RM4 are arranged so as to be asymmetric with respect to rotation of the direction of the paper sheet, and indicate four reference positions corresponding to four corners of a paper sheet, and two reference positions corresponding to two of the centers between the corners of the paper sheet. Also, in the fourth specific example of FIG. 3, since the direction of the corners of the reference marks RM4 having the inverted V shape indicates the set direction of the paper sheet, it is also possible to recognize the set direction of the paper sheet from the shape of the reference marks RM4.

Also, even in each of the first to fourth specific examples of FIG. 3, a message (see the second specific example and the eighth specific example of FIG. 2) for informing the user of the set direction of the paper sheet may be printed in the first chart.

After test printing related to pre-printing is performed by the printing engine 14 included in the printing apparatus 10 of FIG. 1, whereby the first chart is printed on the paper sheet, the paper sheet is set in the paper feeding unit of the printing apparatus having the engine for performing test printing related to post-printing. For example, if the paper sheet is output onto an output tray for pre-printing, the user takes out the paper sheet and sets the paper sheet on an input tray for post-printing.

The paper sheet which is set in the paper feeding unit of the printing apparatus having the engine for performing test printing related to post-printing has the first chart (including, for example, a representative specific example shown as an example in FIG. 2 or FIG. 3) printed thereon by test printing related to pre-printing. Since the direction of the paper sheet can be recognized from the first chart, it is possible to correctly set the paper sheet for post-printing. For example, when the user sets the paper sheet having the first chart printed thereon on a paper feed tray for post-printing, since the user can recognize the set direction of the paper sheet for post-printing if looking at the first chart printed on the paper sheet, the user can correctly set the paper sheet for post-printing.

Figure 4:
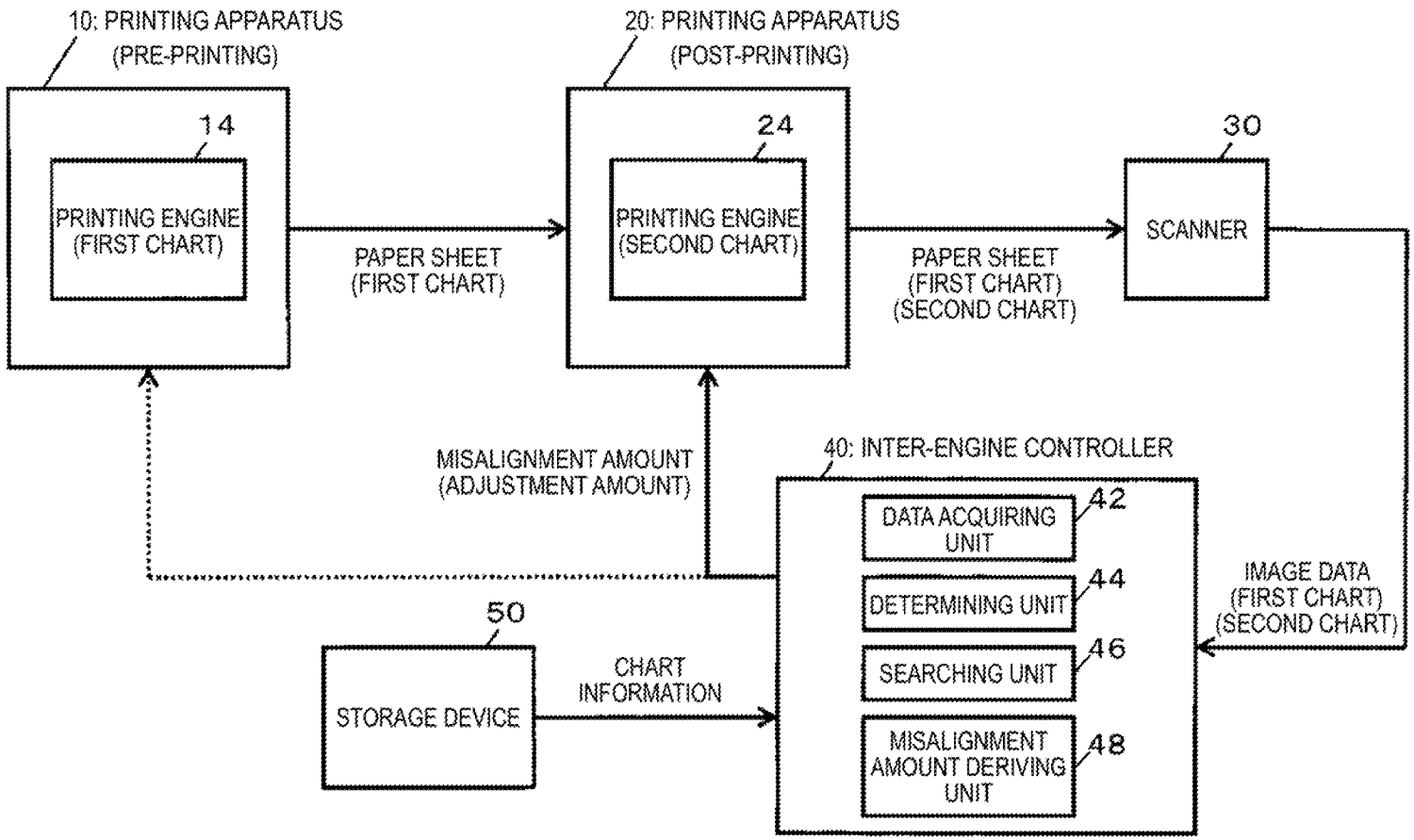
FIG. 4 is a view illustrating a specific example of a printing system according to the exemplary embodiment of the present invention.

FIG. 4 is a view illustrating a specific example of a printing system according to the present exemplary embodiment. FIG. 4 shows a specific example of the printing system for performing an overprinting operation of performing pre-printing on a medium and then performing post-printing on the medium. In the specific example shown in FIG. 4, the printing system includes a printing apparatus 10, a printing apparatus 20, a scanner 30, an inter-engine controller 40, and a storage device 50.

The printing apparatus 10 includes a printing engine 14 for performing pre-printing on media such as paper sheets. A specific example of the printing apparatus 10 shown in FIG. 4 is the printing apparatus 10 shown in FIG. 1. Meanwhile, the printing apparatus 20 shown in FIG. 4 includes a printing engine 24 for performing post-printing on media, such as paper sheets, subjected to pre-printing.

A specific example of pre-printing which the printing apparatus 10 performs is normal printing such as color image printing or monochrome image printing. In the case of performing normal printing as pre-printing, the printing engine 14 is, for example, an electrophotographic full-color print engine, and prints color images or monochrome images on media such as paper sheets with color toner of four colors C, M, Y, and K which are color materials.

Meanwhile, a specific example of post-printing which the printing apparatus 20 performs is special printing using metallic toner, clear toner, or the like. In the case of performing special printing as post-printing, the printing engine 24 performs special printing using metallic toner, clear toner, white toner, toner of colors (two or more colors or a specific color) other than C, M, Y, and K, or the like, on paper sheets on which normal printing has been performed as pre-printing.

For example, in main printing which is performed after test printing, normal printing (color image printing or monochrome image printing) of user's images which are print objects based on a printing instruction received from the user is performed by the printing apparatus 10, and then special printing is performed on the paper sheets subjected to the normal printing by the printing apparatus 20. In this way, for example, a special visual effect using metallic toner, clear toner, white toner, toner of colors (two or more colors or a specific color) other than C, M, Y, and K, or the like is imparted to the user's images, such as images and documents, printed on the paper sheets.

However, in the specific example shown in FIG. 4, special printing may be performed as pre-printing, and normal printing may be performed as post-printing. Also, overprinting which is a combination different from the combination of normal printing and special printing, for example, a combination of normal printing and normal printing or a combination of special printing and special printing, may be performed.

The printing system shown as an example in FIG. 4 has a function of performing test printing for adjustment for overprinting. In other words, the printing engine 14 of the printing apparatus 10 performs test printing related to pre-printing, and the printing engine 24 of the printing apparatus 20 performs test printing related to post-printing.

The printing engine 14 of the printing apparatus 10 prints a first chart asymmetric with respect to rotation of the direction of a paper sheet (a medium) on a paper sheet (a medium) during test printing related to pre-printing. During test printing related to pre-printing, the printing engine 14 may print, for example, a first chart which is a specific example shown in FIG. 2 or FIG. 3. Alternatively, during test printing, the printing engine 14 may print a user's image (an image to be printed during main printing after test printing) together with a first chart on a paper sheet.

The printing engine 24 of the printing apparatus 20 prints a second chart on the paper sheet (the medium) having the first chart printed thereon, during test printing related to post-printing.

Thereafter, the scanner 30 optically reads image data from the paper sheet (the medium) having the first chart and the second chart printed thereon. In this way, the image data of the first chart and the second chart printed on the paper sheet is read. The scanner 30 transmits the read image data to the inter-engine controller 40.

The inter-engine controller 40 includes a data acquiring unit 42, a determining unit 44, a misalignment amount deriving unit 48 for adjusting image misalignment between the pre-printing and the post-printing. The data acquiring unit 42 acquires the image data obtained from the scanner 30. The determining unit 44 determines whether the directions of the pre-printing and the post-printing are correct, and so on, from the image data acquired by the data acquiring unit 42. In determination of the determining unit 44, search results of a searching unit 46 are used. The misalignment amount deriving unit 48 derives a misalignment amount between the printing position of the pre-printing and the printing position of the post-processing.

In the storage device 50, chart information on the first chart and the second chart is stored. In processing which is performed by the inter-engine controller 40, the chart information stored in storage device 50 is used.

However, for example, a multi-function apparatus having a printing function and a copying function may be used to implement a configuration having both of the function of the printing apparatus 20 (or the printing apparatus 10) and the function of the scanner 30, and that multi-function apparatus may be used to implement a configuration having the function of the inter-engine controller 40.

Also, the inter-engine controller 40 may be implemented with, for example, a computer. This computer has hardware resources, such as an arithmetic processing unit such as a CPU, storage devices such as a memory and a hard disk, a communication device for using a communication line such as the Internet, a device for reading data from storage media such as optical disks and semiconductor memories and writing data on storage media, a display device such as display, and an operation device for receiving user's operations.

Further, for example, a program (software) corresponding to the data acquiring unit 42, the determining unit 44, the searching unit 46, and the misalignment amount deriving unit 48 shown in FIG. 4 can be loaded into the computer, and the hardware resources included in the computer and the loaded software can cooperate with each other such that the function of at least one of the data acquiring unit 42, the determining unit 44, the searching unit 46, and the misalignment amount deriving unit 48 are implemented by the computer. This program may be provided to the computer via a communication network such as the Internet, or may be stored in a storage medium such as an optical disk and be loaded from the storage medium into the computer.

Now, a specific example of test printing which is performed by the printing system of FIG. 4 will be described. Also, in the following description, components identical to those (the units having reference symbols) of FIG. 4 are denoted by the same reference symbols as those of FIG. 4.

Figure 5:
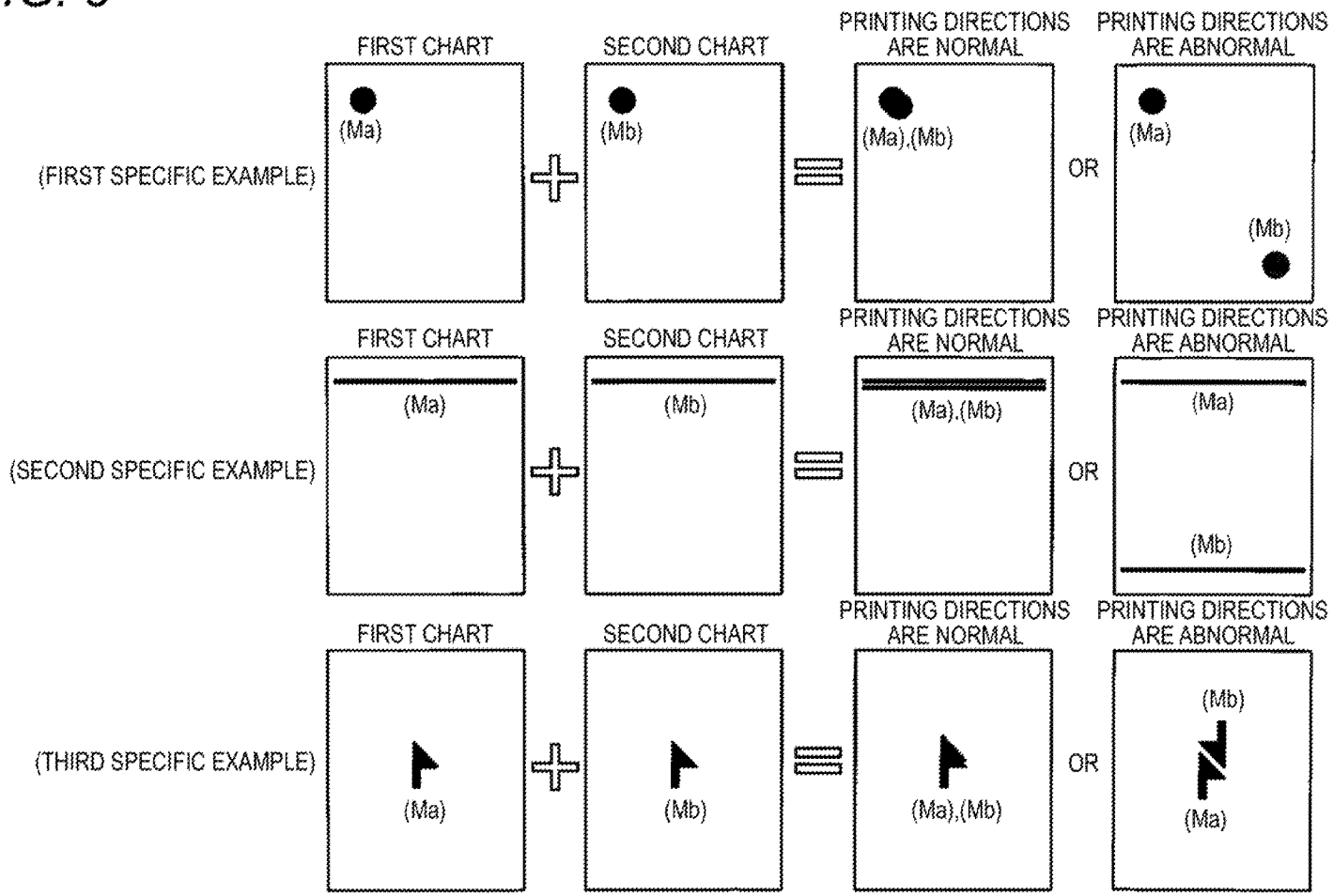
FIG. 5 is a view illustrating specific examples of printing-direction determination.
Figure 6:
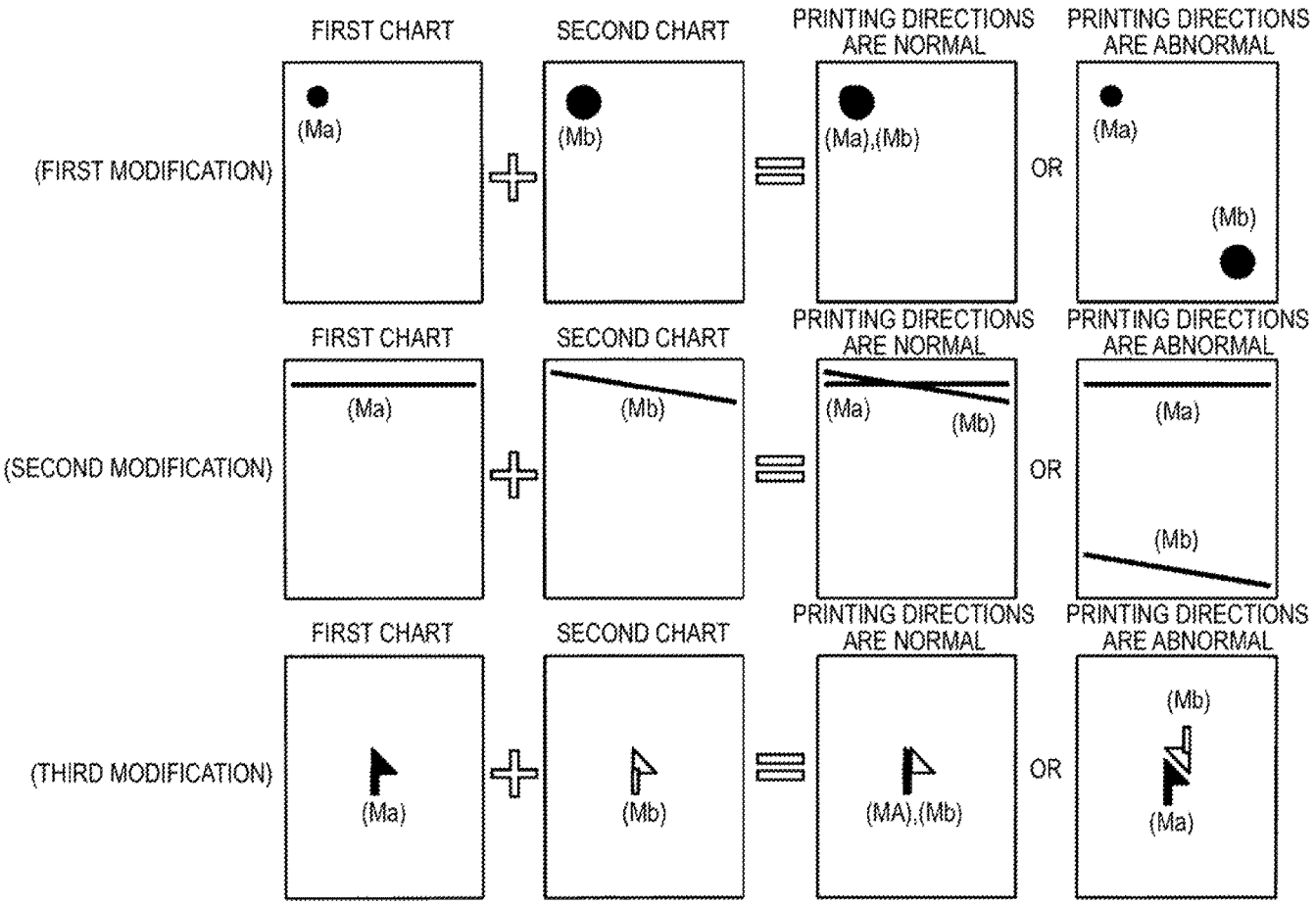
FIG. 6 is a view illustrating modifications of printing-direction determination.

FIG. 5 and FIG. 6 are specific examples of printing-direction determination which is performed by the printing system of FIG. 4. In the printing system of FIG. 4, the printing engine 14 of the printing apparatus 10 prints a first chart asymmetric with respect to rotation of the direction of a paper sheet, on a paper sheet, during test printing related to pre-printing, and the printing engine 24 of the printing apparatus 20 prints a second chart on the paper sheet having the first chart printed thereon. Subsequently, the scanner 30 reads image data of the first chart and the second chart printed on the paper sheet, and from the image data read by the scanner 30, the determining unit 44 of the inter-engine controller 40 determines whether the directions of the pre-printing and the post-printing are correct.

FIG. 5 and FIG. 6 show specific examples of first charts and second charts which can be used in printing-direction determination which is performed by the printing system of FIG. 4, and specific examples of determination results.

In a first specific example of FIG. 5, a specific example of determination using a first chart including a circular mark Ma and a second chart including a circular mark Mb is shown. The positions where the circular marks Ma and Mb are arranged indicate paper sheet directions (see the first specific example of FIG. 2). For example, the circular mark Ma is arranged in the vicinity of the outer edge of the leading part of the paper sheet in the paper set direction of pre-printing, for example, on the lead side of pre-printing. Also, the circular mark Mb is arranged in the vicinity of the outer edge of the leading part of the paper sheet in the paper set direction of post-printing, for example, the lead side of post-printing.

Therefore, if it is determined from the image data read from the paper sheet having the first chart and the second chart printed thereon by the scanner 30 that the circular marks Ma and Mb are on the same outer edge side of the paper sheet, it is determined that the direction of the pre-printing (for example, the lead side during printing) and the direction of the post-printing (for example, the lead side during printing) are the same and the directions of the pre-printing and the post-printing are normal.

For this reason, the determining unit 44 of the inter-engine controller 40 detects the circular marks Ma and Mb from the image data acquired from the scanner 30 by the data acquiring unit 42, for example, by a known image detection process. Subsequently, the determining unit 44 determines whether the directions of the pre-printing and the post-printing are correct, according to whether the circular marks Ma and Mb overlap.

For example, in the case where the circular mark Ma and the circular mark Mb overlap (even in the case where they partially overlap), it is determined that the circular marks Ma and Mb printed are on the same outer edge side of the paper sheet, and it is determined that the direction of the pre-printing and the direction of the post-printing are normal. Meanwhile, in the case where the circular mark Ma and the circular mark Mb do not overlap (for example, in the case where the circular marks are separate from each other), it is determined that the circular marks Ma and Mb printed are not on the same outer edge side of the paper sheet, and it is determined that the direction of the pre-printing and the direction of the post-printing are abnormal (not normal). Also, in the case where the circular marks are in a state as shown by "PRINTING DIRECTIONS ARE ABNORMAL" in the first specific example of FIG. 5, a mark is shown on the lower left part of the paper sheet shown in FIG. 5 where any mark should not exist in a normal state. For this reason, for example, by detecting whether any mark is in the lower right area of the paper sheet as shown in FIG. 5, it is possible to determine whether the direction of the pre-printing and the direction of the post-printing are normal.

In a second specific example of FIG. 5, a specific example of determination using a first chart including a straight-line mark Ma and a second chart including a straight-line mark Mb is shown. The positions where the straight-line marks Ma and Mb are arranged indicate paper sheet directions (see the fourth specific example of FIG. 2). For example, the straight-line mark Ma is arranged in the vicinity of the outer edge of the leading part of the paper sheet in the paper set direction of pre-printing, and the straight-line mark Mb is arranged in the vicinity of the outer edge of the leading part of the paper sheet in the paper set direction of post-printing.

Even in the second specific example of FIG. 5, the determining unit 44 of the inter-engine controller 40 determines whether the straight-line marks Ma and Mb overlap, from image data acquired from the scanner 30 by the data acquiring unit 42, thereby determining whether the direction of the pre-printing and the direction of the post-printing are normal. Also, similarly to the first specific example, for example, by detecting whether any mark (line) is in the lower area of the paper sheet of FIG. 5, it is possible to determine whether the direction of the pre-printing and the direction of the post-printing are normal.

For example, in the case where the straight-line mark Ma and the straight-line mark Mb overlap (even in the case where they partially overlap), it is determined that the straight-line marks Ma and Mb printed are on the same outer edge side of the paper sheet, and it is determined that the direction of the pre-printing and the direction of the post-printing are normal. Alternatively, in the case where the distance between the straight-line mark Ma and the straight-line mark Mb (for example, an average distance, a maximum distance, or the like) is smaller than a determination threshold, it may be determined that the straight-line marks Ma and Mb printed are on the same outer edge side of the paper sheet. Meanwhile, in the case where the straight-line mark Ma and the straight-line mark Mb do not overlap (for example, in the case where the straight-line marks are separate from each other), it is determined that the straight-line marks Ma and Mb printed are not on the same outer edge side of the paper sheet, and it is determined that the direction of the pre-printing and the direction of the post-printing are abnormal (not normal).

In the third specific example of FIG. 5, a specific example of determination using a first chart including an arrow-shaped mark Ma and a second chart including an arrow-shaped mark Mb is shown. The shapes of the arrow-shaped marks Ma and Mb indicate paper sheet directions (see the seventh specific example of FIG. 2). For example, the arrow direction of the mark Ma indicates the paper set direction of pre-printing, for example, the lead side of pre-printing, and the arrow direction of the mark Mb indicates the paper set direction of post-printing, for example, the lead side of post-printing In the third specific example of FIG. 5, from image data acquired from the scanner 30 by the data acquiring unit 42, the determining unit 44 of the inter-engine controller 40 detects the arrow-shaped marks Ma and Mb, for example, by a known image detection process. Subsequently, the determining unit 44 determines whether the directions of the pre-printing and the post-printing are correct, according to whether the arrow-shaped marks Ma and Mb indicate the same direction.

For example, in the case where the arrow-shaped mark Ma and the arrow-shaped mark Mb overlap (for example, in the case where the area of a part of a mark which overlaps the other mark is larger than the area of the other part which does not overlap the other mark), it is determined that the arrow-shaped marks Ma and Mb indicate the same direction, and it is determined that the direction of the pre-printing and the direction of the post-printing are normal. Meanwhile, in the case where the arrow-shaped mark Ma and the arrow-shaped mark Mb do not overlap (for example, in the case where the area of a part of a mark which overlaps the other mark is smaller than the area of the other part which does not overlap the other mark), it is determined that the arrow-shaped marks Ma and Mb do not indicate the same direction, and it is determined that the direction of the pre-printing and the direction of the post-printing are abnormal (not normal).

A first modification of FIG. 6 is a modification of the first specific example of FIG. 5. The first modification of FIG. 6 is obtained by setting different sizes (magnitudes) for the circular mark Ma and the circular mark Mb of the first specific example of FIG. 5. Even in the first modification of FIG. 6, from image data acquired from the scanner 30 by the data acquiring unit 42, the determining unit 44 of the inter-engine controller 40 detects the circular marks Ma and Mb, for example, by a known image detection process. Subsequently, the determining unit 44 determines whether the directions of the pre-printing and the post-printing are correct, according to whether the circular marks Ma and Mb overlap.

For example, in the case where the circular mark Ma and the circular mark Mb overlap (even in the case where they partially overlap), it is determined that the direction of the pre-printing and the direction of the post-printing are normal; whereas in the case where the circular mark Ma and the circular mark Mb do not overlap (for example, in the case where the circular marks are separate from each other), it is determined that the direction of the pre-printing and the direction of the post-printing are abnormal (not normal).

In the first modification of FIG. 6, since the sizes of the mark Ma and the mark Mb are different, from the magnitude relationship between the sizes, it is possible to recognize that the mark Ma corresponds to a first chart printed by the printing engine 14, and it is possible to recognize that the mark Mb corresponds to a second chart printed by the printing engine 24. Also, it is possible to set different shapes for the mark Ma and the mark Mb, such that from the difference between the shapes, it is possible to recognize which of the printing engine 14 and the printing engine 24 each mark corresponds to.

A second modification of FIG. 6 is a modification of the second specific example of FIG. 5. The second modification of FIG. 6 is obtained by setting different angles (inclinations) for the straight-line mark Ma and the straight-line mark Mb of the second specific example of FIG. 5. Even in the second modification of FIG. 6, from image data acquired from the scanner 30 by the data acquiring unit 42, the determining unit 44 of the inter-engine controller 40 determines whether the straight-line marks Ma and Mb overlap (for example, whether the straight-line marks Ma and Mb intersect with each other), thereby determining whether the direction of the pre-printing and the direction of the post-printing are correct.

For example, in the case where the straight-line mark Ma and the straight-line mark Mb overlap (the marks intersect with each other), it is determined that the direction of the pre-printing and the direction of the post-printing are normal; whereas in the case where the straight-line mark Ma and the straight-line mark Mb do not overlap (the marks do not intersect with each other), it is determined that the direction of the pre-printing and the direction of the post-printing are abnormal (not normal).

In the second modification of FIG. 6, since the angles (inclinations) of the mark Ma and the mark Mb are different, from the difference between the angles, it is possible to recognize that the mark Ma corresponds to a first chart printed by the printing engine 14, and it is possible to recognize that the mark Mb corresponds to a second chart printed by the printing engine 24. Also, it is possible to set different positions for the mark Ma and the mark Mb such that from the difference between the positions, it is possible to recognize which of the printing engine 14 and the printing engine 24 each mark corresponds to.

A third modification of FIG. 6 is a modification of the third specific example of FIG. 5. The third modification of FIG. 6 is obtained by imparting different characters such as different densities or different colors to the arrow-shaped mark Ma and the arrow-shaped mark Mb of the third specific example of FIG. 5. Even in the third modification of FIG. 6, from image data acquired from the scanner 30 by the data acquiring unit 42, the determining unit 44 of the inter-engine controller 40 determines whether the arrow-shaped marks Ma and Mb indicate the same direction, thereby determining whether the direction of the pre-printing and the direction of the post-printing are correct.

For example, in the case where the arrow-shaped mark Ma and the arrow-shaped mark Mb overlap (for example, in the case where the area of a part of a mark which overlaps the other mark is larger than the area of the other part which does not overlap the other mark), it is determined that the arrow-shaped marks Ma and Mb indicate the same direction, and it is determined that the direction of the pre-printing and the direction of the post-printing are normal. Meanwhile, in the case where the arrow-shaped mark Ma and the arrow-shaped mark Mb do not overlap (for example, in the case where the area of a part of a mark which overlaps the other mark is smaller than the area of the other part which does not overlap the other mark), it is determined that the arrow-shaped marks Ma and Mb do not indicate the same direction, and it is determined that the direction of the pre-printing and the direction of the post-printing are abnormal (not normal).

In the third modification of FIG. 6, since the characteristics such as densities or colors of the mark Ma and the mark Mb are different, from the difference between the characteristics such as densities or colors, it is possible to recognize that the mark Ma corresponds to a first chart printed by the printing engine 14, and it is possible to recognize that the mark Mb corresponds to a second chart printed by the printing engine 24.

For example, as described with reference to FIG. 5 and FIG. 6, printing-direction determination is implemented by test printing which is performed by the printing system of FIG. 4. Further, the printing system of FIG. 4 has a function of performing adjustment for overprinting.

Figure 7:
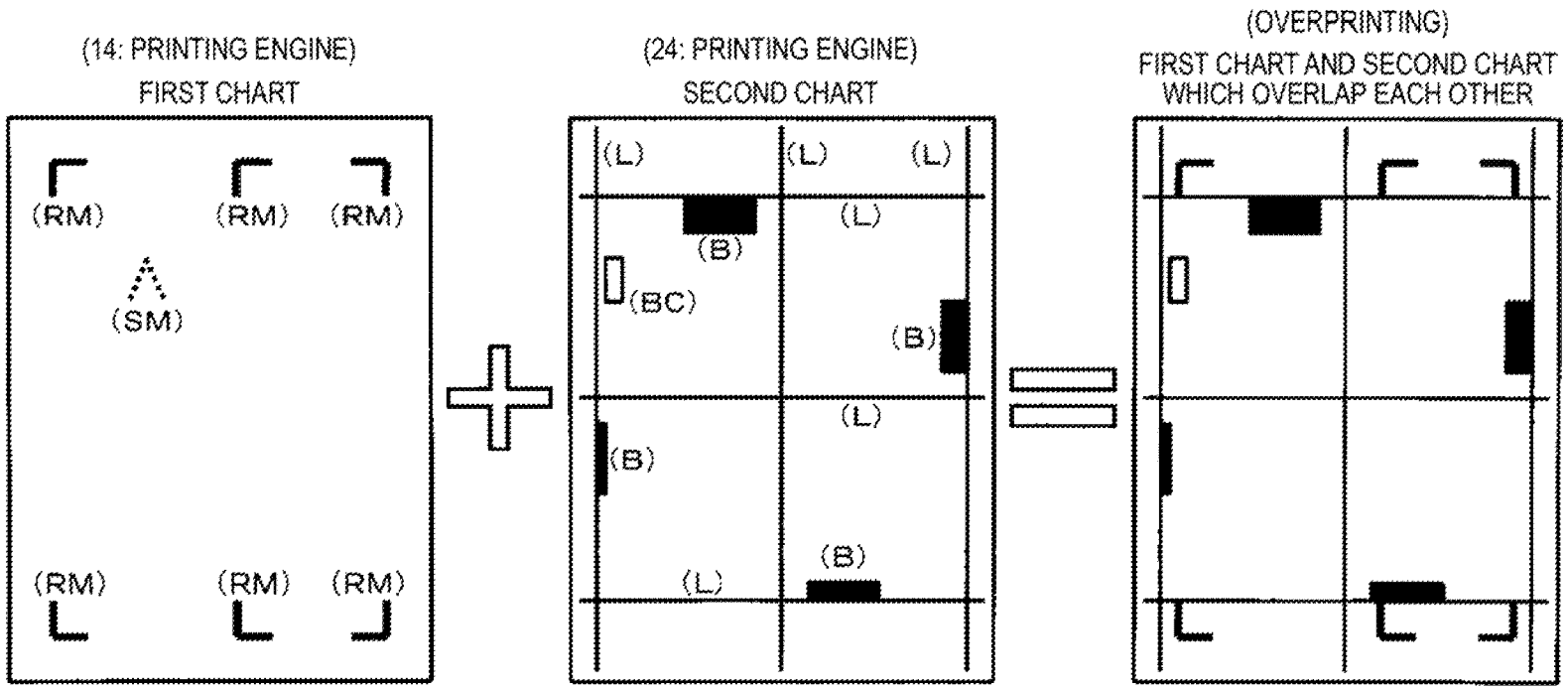
FIG. 7 is a view illustrating specific examples of charts which are used for adjustment for overprinting.

FIG. 7 is a view illustrating specific examples of charts which can be used in adjustment for overprinting. On the occasion of performing adjustment for overprinting, the printing engine 14 of the printing apparatus 10 prints a first chart including two or more reference marks arranged so as to be asymmetric with respect to rotation of a paper sheet direction, during test printing of pre-printing.

In FIG. 7, as a specific example of a first chart which can be used in adjustment for overprinting, a first chart including uncinate reference marks RM indicating reference positions (see the first specific example of FIG. 3) is shown. For example, the corner of each uncinate reference mark RM indicates a reference position, and six reference marks RM indicate six reference positions. In other words, the six reference marks RM indicate four reference positions corresponding to four corners of a paper sheet, and two reference positions corresponding to two of the centers between the corners of the paper sheet.

Also, in the specific example shown in FIG. 7, the first chart includes a direction mark SM indicating a paper sheet direction (the paper set direction for post-printing). In the specific example of FIG. 7, the direction mark SM is a broken line and its shape (the direction of the corner) indicates the paper set direction.

In FIG. 7, a specific example of a second chart which can be used for adjustment for overprinting is also shown. On the occasion of performing adjustment for overprinting, the printing engine 24 of the printing apparatus 20 prints a second chart indicating search reference positions by test printing of post-printing.

In FIG. 7, as a specific example of a second chart which can be used for adjustment for overprinting, a second chart including straight lines L, bars B, and a barcode BC is shown. For example, each intersection point (a grid point) of two different straight lines L indicates a search reference position. Also, the thicknesses of the bars B indicate a paper sheet direction. For example, the thickest bar B of four bars B is arranged on the lead side of post-printing.

On the occasion of performing adjustment for overprinting, the first chart is printed on a paper sheet by test printing of pre-printing, and the second chart is printed on the paper sheet having the first chart printed thereon by test printing of post-printing. In this way, the first chart and the second chart are printed on a paper sheet such that the charts overlap.

Also, prior to adjustment for overprinting, chart information on the first chart and the second chart is stored in the storage device 50. The chart information includes ideal position information representing the ideal relationship between the positions of the first chart and the second chart.

Figure 8:
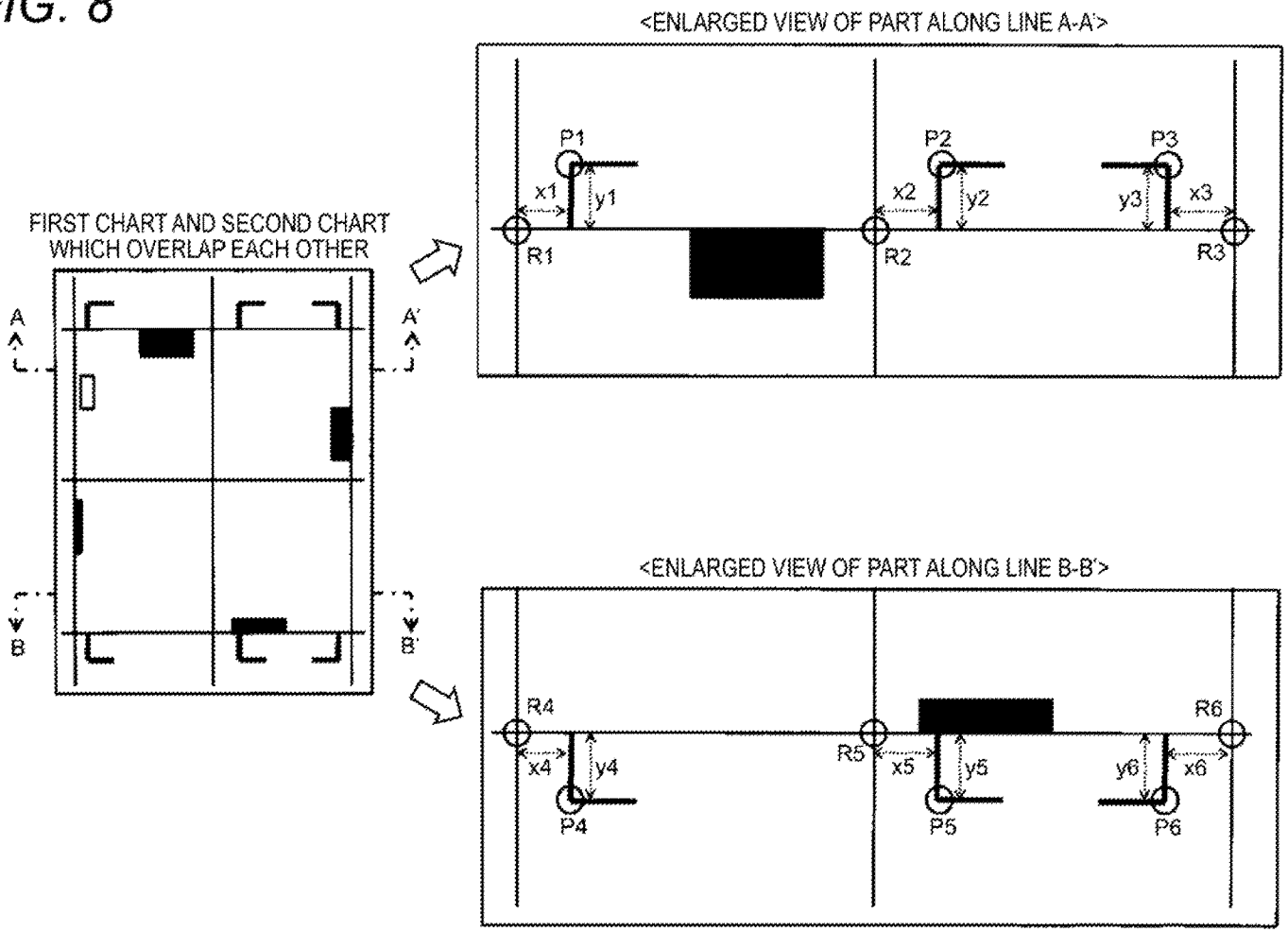
FIG. 8 is a view illustrating a specific example of ideal position information which is included in chart information.

FIG. 8 is a view illustrating a specific example of the ideal position information which is included in the chart information. In FIG. 8, ideal position information on the first chart and the second chart shown as examples in FIG. 7 is shown.

In the specific example of FIG. 7, the first chart includes the six reference marks RM, and the six reference marks RM indicate six reference positions. In FIG. 8, the six reference positions are shown and are denoted by Pt to P6.

Also, in the specific example of FIG. 7, the second chart includes the straight lines L, and each intersection point (a grid point) of two different straight lines L indicates a search reference position. In FIG. 8, six search reference positions R1 to R6 corresponding to the six reference positions P1 to P6 are shown.

The ideal position information is information representing the relationship between the positions of the first chart and the second chart which is obtained in the case where ideal overprinting is performed such that printing-position misalignment between pre-printing and post-printing does not occur. In the specific example shown in FIG. 8, as the ideal position information, ideal relative position information between each pair of a reference position and a search reference position corresponding to each other, of the reference positions indicated by the first chart and the search reference positions indicated by the second chart is used.

For example, in the specific example shown in FIG. 8, the reference position P1 indicated by the first chart and the search reference position R1 indicated by the second chart correspond to each other, and the difference between the x coordinate values of the reference position P1 and the search reference position R1 and the difference between the y coordinate values of them which is obtained in the case of performing ideal overprinting become relative position information (x1, y1).

Similarly, in the specific example shown in FIG. 8, relative position information (x2, y2) of the reference position P2 and the search reference position R2, relative position information (x3, y3) of the reference position P3 and the search reference position R3, relative position information (x4, y4) of the reference position P4 and the search reference position R4, relative position information (x5, y5) of the reference position P5 and the search reference position R5, and relative position information (x6, y6) of the reference position P6 and the search reference position R6 become ideal relative position information between the pairs of reference positions and search reference positions corresponding to each other.

In the storage device 50, for example, the ideal relative position information between the pairs of reference positions and search reference positions corresponding to each other, shown as examples in FIG. 8, is stored as chart information.

Figure 9:
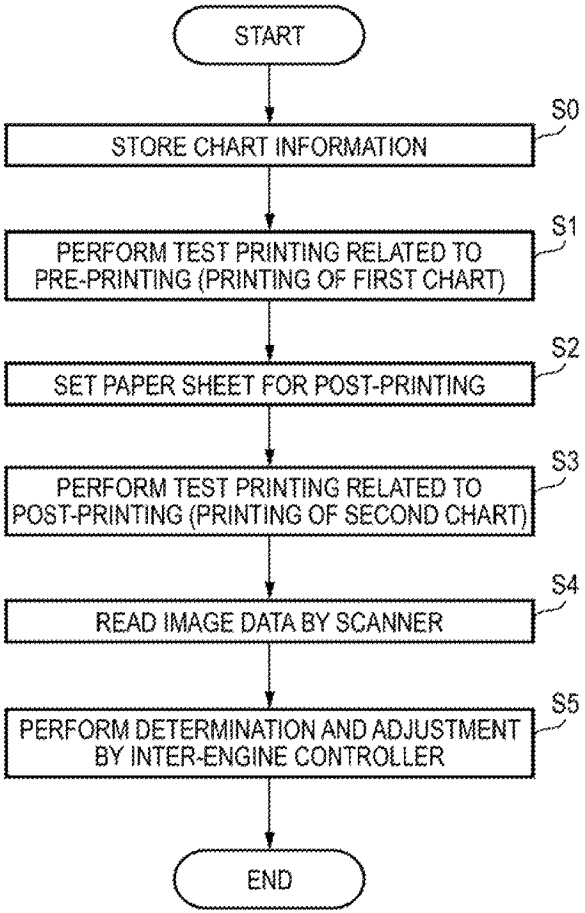
FIG. 9 is a view illustrating a specific example of a procedure related to adjustment for overprinting.

FIG. 9 is a view illustrating a specific example of a procedure related to adjustment for overprinting. In FIG. 9, a specific example of the procedure related to adjustment for overprinting which is performed by the printing system of FIG. 4 is shown by a flow chart. Examples of such adjustment include adjustment of image formation position misalignment between pre-printing and post-printing, magnification adjustment, and so on. Prior to adjustment for overprinting, chart information on a first chart and a second chart is stored in the storage device 50 (STEP S0). For example, with respect to the first chart and the second chart of the specific example shown in FIG. 7, chart information including the relative position information (x1, y1) to (x6, y6) shown in FIG. 8 is stored in the storage device 50.

For adjustment for overprinting, first, test printing related to pre-printing is performed (STEP S1). For example, the user sets a paper sheet for test printing on a paper tray corresponding to the printing engine 14 of the printing apparatus 10, and the user issues an instruction to perform test printing of the first chart by operating the operation device or the like of the printing apparatus 10. As a result, the printing engine 14 prints the first chart.

Subsequently, the user sets the paper sheet for post-printing (STEP S2). For example, after the first chart is printed on the paper sheet by test printing of STEP S related to pre-printing, if the paper sheet is output onto an output tray corresponding to the printing engine 14 of the printing apparatus 10, the user sets the paper sheet on a paper tray corresponding to the printing engine 24 of the printing apparatus 20.

When the user sets the paper sheet in STEP S2, since the first chart printed on the paper sheet indicates the set direction of the corresponding paper sheet (see the first specific example of FIG. 3 for instance), with reference to the set direction indicated by the first chart printed on the paper sheet, the user sets the paper sheet on the paper tray corresponding to the printing engine 24 of the printing apparatus 20 such that the direction of the paper sheet coincides with the correct direction. In this way, it is possible to correctly set the paper sheet for post-printing. Alternatively, for example, an image indicating the correct direction of the paper sheet (for example, the correct direction of the first chart) may be displayed on a display device included in the printing apparatus 20, or a drawing or the like indicating the correct direction of the paper sheet may be provided on the paper tray corresponding to the printing engine 24 or around the paper tray.

If the paper sheet for post-printing is set, test printing related to post-printing is performed (STEP S3). For example, the user issues an instruction to perform test printing of the second chart by operating the operation device or the like of the printing apparatus 20. As a result, the printing engine 24 prints the second chart.

Next, reading of image data is performed by the scanner 30 (STEP S4). For example, after the first chart is printed on the paper sheet by test printing of STEP S1 related to pre-printing and the second chart is printed on the paper sheet by test printing of STEP S3 related to post-printing, if the paper sheet is output onto the output tray corresponding to the printing engine 24 of the printing apparatus 20, the user sets the paper sheet on the scanner 30, and issues an instruction to read image data. As a result, image data of the first chart and the second chart printed by overprinting is read.

Subsequently, the data acquiring unit 42 of the inter-engine controller 40 acquires the image data read by the scanner 30, and a printing-direction determination process and an adjustment process for overprinting are performed by the inter-engine controller 40 (STEP S5).

Figure 10:
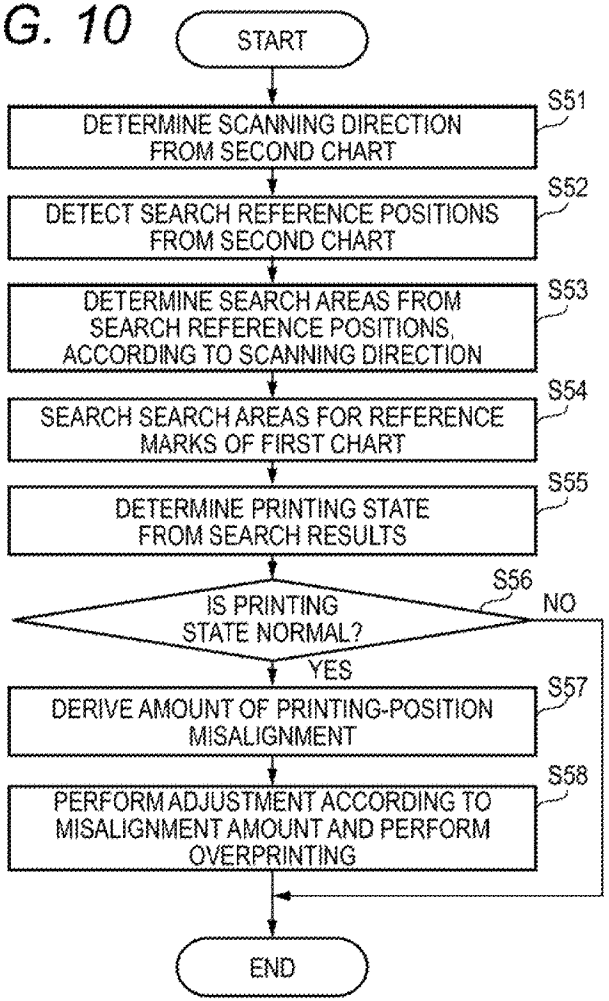
FIG. 10 is a view illustrating a specific example of processing which is performed by an inter-engine controller.

FIG. 10 is a view illustrating a specific example of processing which is performed by the inter-engine controller 40. In FIG. 10, a specific example of processing which is performed in STEP S5 of FIG. 9 by the inter-engine controller 40 is shown by a flow chart. The inter-engine controller 40 performs the processing shown by the flow chart of FIG. 10, on the acquired image data, for example, using a known image detection process.

If acquiring the image data, the inter-engine controller 40 first determines a scanning direction from the second chart included in the image data (STEP S51). For example, if acquiring the image data of the first chart and the second chart of the specific example shown in FIG. 7, the determining unit 44 of the inter-engine controller 40 detects the four bars B included in the second chart included in the image data. Subsequently, the thicknesses of the four bars B are detected, and the thickest bar B is specified. Since the thickest bar is arranged on the lead side of post-printing, the side where there is the thickest bar B in the image data is determined as the lead side of post-printing.

Subsequently, the inter-engine controller 40 detects search reference positions from the second chart included in the image data (STEP S52). For example, with reference to the positions of the four bars B detected from the image data, the searching unit 46 of the inter-engine controller 40 detects the six search reference positions R1 to R6 (see FIG. 8) indicated by the second chart.

For example, if information on the relative position relationship of the positions of the four bars B and the six search reference positions R1 to R6 is stored in the storage device 50 in advance, the searching unit 46 specifies areas apart from the positions of the four bars B detected from the image data by distances according to the relative position information included in the chart information, and detects the six search reference positions R1 to R6 included in the image data, for example, by searching the specified areas and the vicinities of the specified areas. However, besides the grid points corresponding to the six search reference positions R1 to R6, any other grid point (any other intersection point of two different straight lines L) included in the second chart may be detected.

Next, the inter-engine controller 40 determines search areas from the search reference positions, according to the scanning direction (STEP S53). For example, the searching unit 46 of the inter-engine controller 40 determines search areas in the image data, on the basis of the search reference positions detected in STEP S52, according to the scanning direction determined in STEP S51.

Figure 11:
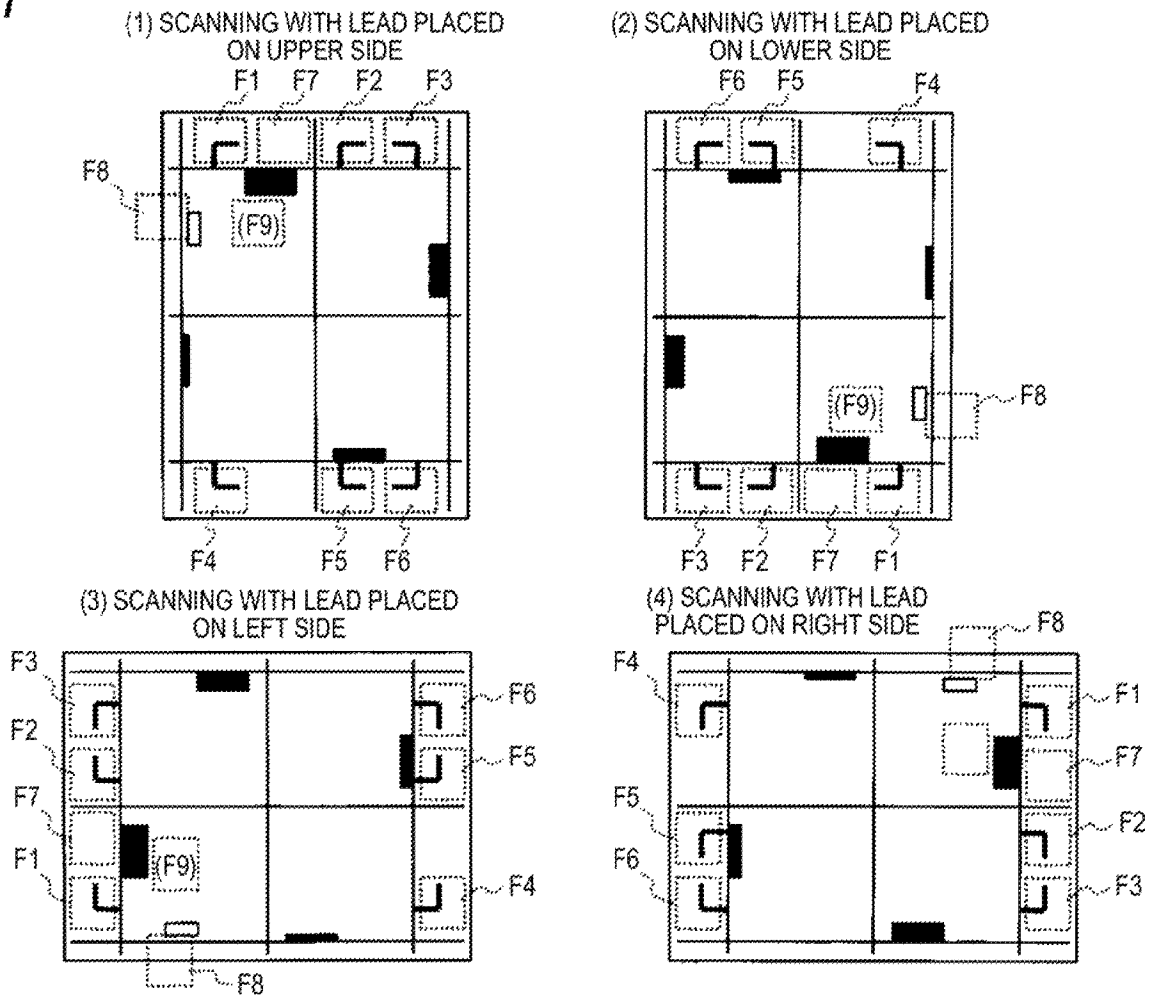
FIG. 11 is a view illustrating specific examples of search areas which are determined according to scanning directions.

FIG. 11 is a view illustrating a specific example of the search areas which are determined according to the scanning direction. In the specific example shown in FIG. 11, nine search areas F1 to F9 are set in the image data. The search areas F1 to F9 are determined on the basis of the search reference positions detected in STEP S52 of FIG. 10.

For example, the search area F1 shown in FIG. 11 is set such that a position (an ideal position of the reference position P1) deviated from the search reference position R1 of FIG. 8 by the relative position (x1, y1) becomes the center. Also, the search area F2 shown in FIG. 11 is set such that a position (an ideal position of the reference position P2) deviated from the search reference position R2 of FIG. 8 by the relative position (x2, y2) becomes the center.

Further, the search area F3 is set such that a position deviated from the search reference position R3 by the relative position (x3, y3) becomes the center, and the search area F4 is set such that a position deviated from the search reference position R4 by the relative position (x4, y4) becomes the center, and the search area F5 is set such that a position deviated from the search reference position R5 by the relative position (x5, y5) becomes the center, and the search area F6 is set such that a position deviated from the search reference position R6 by the relative position (x6, y6) becomes the center. The relative positions (x1, y1) to (x6, y6) are relative position information obtained from the chart information stored in the storage device 50.

Also, in the specific example shown in FIG. 11, the search area F7 is set between the search area F1 and the search area F2. The positions of the search area F7 and the search area F2 are symmetric to each other about a line. For example, the search area F7 shown in FIG. 11 is set such that a position deviated from the search reference position R2 shown in FIG. 8 by a relative position (−x2, y2) becomes the center.

Furthermore, in the specific example shown in FIG. 11, the search area F8 is set around the barcode BC (see FIG. 7), and the search area F9 is set at a position corresponding to the direction mark SM (see FIG. 7) included in the first chart.

Therefore, in the case where scanning (reading of image data) has been performed with the lead (the lead side of post-printing indicated by the second chart) placed on the upper side, since the lead is on the upper side in the image data, for example, as shown in (1) of FIG. 11, the search areas F1, F7, F2, and F3 are set on the upper side in the image data, and the search areas F4, F5, and F6 are set on the lower side in the image data.

Also, in the case where scanning has been performed with the lead placed on the lower side, since the lead is on the lower side in the image data, for example, as shown in (2) of FIG. 11, the search areas F1, F7, F2, and F3 are set on the lower side in the image data, and the search areas F4, F5, and F6 are set on the upper side in the image data.

Also, in the case where scanning has been performed with the lead placed on the left side, since the lead is on the left side in the image data, for example, as shown in (3) of FIG. 11, the search areas F1, F7, F2, and F3 are set on the left side in the image data, and the search areas F4. F5, and F6 are set on the right side in the image data.

Also, in the case where scanning has been performed with the lead placed on the right side, since the lead is on the right side in the image data, for example, as shown in (4) of FIG. 11, the search areas F1, F7, F2, and F3 are set on the right side in the image data, and the search areas F4, F5, and F6 are set on the left side in the image data. Also, the search areas F8 and F9 are set as shown in (1) to (4) of FIG. 11.

Hereinafter, FIG. 10 will be further described. If the search areas are determined in the image data, the inter-engine controller 40 searches the search areas for the reference marks of the first chart (STEP S54). For example, the searching unit 46 of the inter-engine controller 40 searches each search area of the search areas F1 to F9 for the reference marks, thereby checking whether there is any reference mark in each search area of the search areas F1 to F9.

Subsequently, the inter-engine controller 40 determines the printing state of the post-printing from the search results of STEP S54 (STEP S55). For example, the determining unit 44 of the inter-engine controller 40 determines whether the printing state is normal, according to the results of reference mark detection performed on the search areas F1 to F9.

Figure 13B:
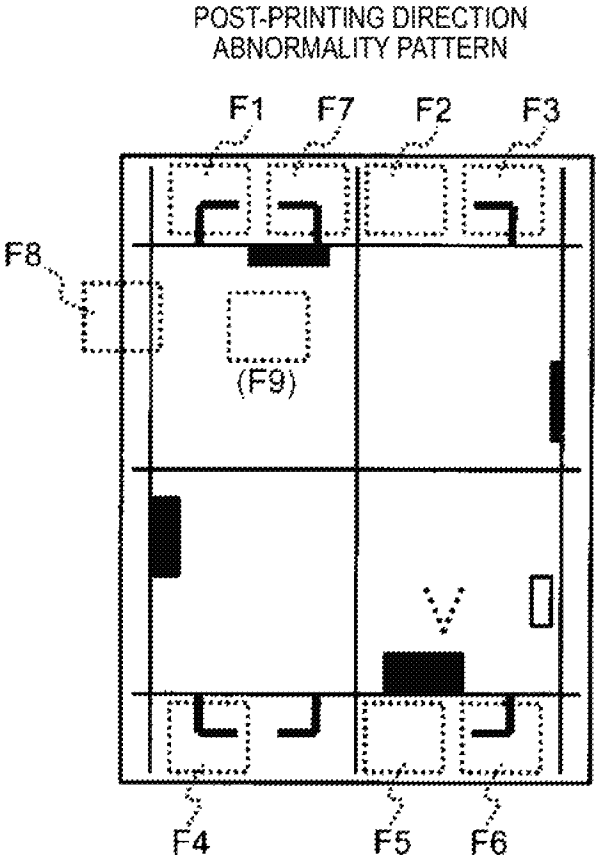
FIGS. 13A and 13B are views illustrating specific examples of a normal pattern and abnormal patterns related to printing states.

FIG. 12 is a view illustrating a specific example related to determination of the printing state. Also, FIGS. 13A and 13B are views illustrating specific examples of a normal pattern and abnormal patterns related to printing states.

Figure 13A:
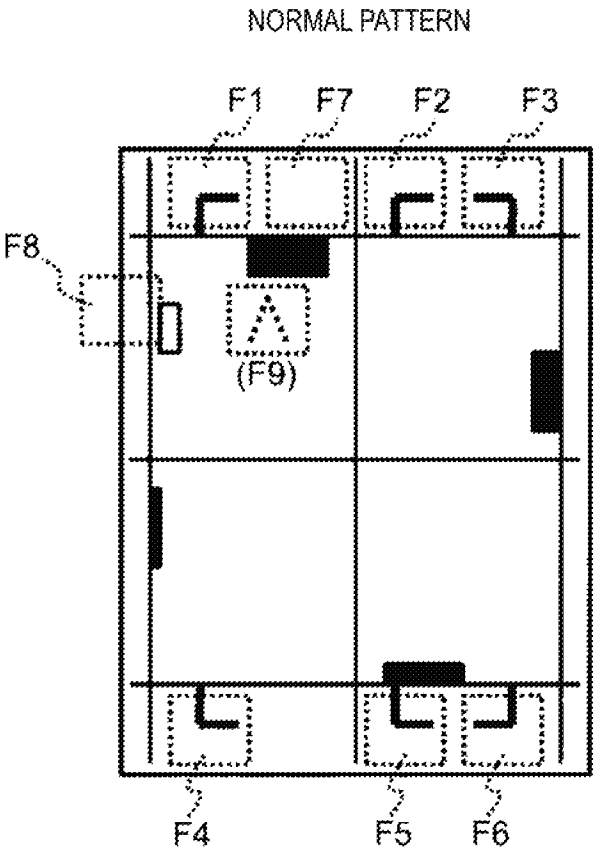

If the direction of the pre-printing and the direction of the post-printing coincide with each other and the printing state of the overprinting is normal, for example, as shown in FIG. 13A, the direction of the first chart and the direction of the second chart are aligned. In the case of the normal pattern, since the six reference marks included in the first chart are inside six search areas F1 to F6, the reference marks are detected from the six search areas F1 to F6. Also, in the case of the normal pattern, since there is no reference mark in each of the search areas F7 and F8, any reference mark is not detected from the search areas F7 and F8.

Also, if a direction mark indicating the paper sheet direction (the direction mark SM of FIG. 7) is printed only on a rear side, the direction mark is not detected from the search area F9 specified in the front side.

For this reason, in the case where the detection results of the search areas F1 to F6 are "DETECTED" and the detection results of the search areas F7 and F8 are "NOT DETECTED" as shown in FIG. 12, since the direction of the pre-printing and the direction of the post-printing coincide with each other, the determining unit 44 of the inter-engine controller 40 determines that the printing state of the overprinting is the normal pattern.

In contrast, in the case where the direction of the post-printing is abnormal, for example, in the case where the direction of the post-printing is opposite to the direction of the pre-printing, as shown in FIG. 13B, if the direction of the second chart is upward, the direction of the first chart is downward. In the case of this post-printing direction abnormality pattern, from the positions of the search areas F2 and F5 where reference marks should be detected in the normal state, any reference mark is not detected, and from the position of the search area F7 where any reference mark should not be detected, a reference mark is detected. Also, in the case of the post-printing direction abnormality pattern shown as an example in FIG. 13B, from the positions of the search areas F1, F3, F4, and F6, reference marks are detected, and from the search area F8, any reference mark is not detected.

For this reason, in the case where the detection results of the search areas F1, F3, F4, F6, and F7 are "DETECTED" and the detection results of the search areas F2, F5, and F8 are "NOT DETECTED" as shown in FIG. 12, since the direction of the post-printing is opposite to the direction of the pre-printing, the determining unit 44 of the inter-engine controller 40 determines that the printing state of the overprinting is the post-printing direction abnormality pattern.

Also, the determining unit 44 of the inter-engine controller 40 may determine the printing state as a determination pattern other than the normal pattern and the post-printing direction abnormality pattern. For example, in the case where the detection result of only the search area F4 of the search areas F1 to F6 where the detection result "DETECTED" should be obtained in the normal pattern is "NOT DETECTED" as shown in FIG. 12, the determining unit may determine a detection failure pattern representing that it is impossible to determine whether the printing state is the normal pattern or the post-printing direction abnormality pattern.

Hereinafter. FIG. 10 will be further described. If the result of printing-state determination of STEP S55 is normal (STEP S56), the inter-engine controller 40 derives the amount of printing-position misalignment (STEP S57). For example, the misalignment amount deriving unit 48 of the inter-engine controller 40 derives the amount of misalignment between the printing position of the pre-printing and the printing position of the post-printing, using the reference positions (the reference positions of the pre-printing) obtained from the reference marks included in the first chart included in the image data, and the search reference positions (the reference positions of the post-printing) obtained from the second chart included in the image data.

For example, on the basis of the reference position P1 (see FIG. 8) indicated by the reference mark detected from the search area F1 in STEP S54, and the search reference position R1 (see FIG. 8) detected in STEP S52, the relative position (x1, y1) between the reference position P1 and the search reference position R1 detected from the image data is obtained. Subsequently, from the difference between the detected relative position (x1, y1) and the ideal relative position (x1, y1) included in the chart information acquired from the storage device 50, a misalignment amount corresponding to the reference position P1 (the search reference position R1) is derived.

Also, on the basis of the reference position P2 (see FIG. 8) indicated by the reference mark detected from the search area F2 in STEP S54, and the search reference position R2 (see FIG. 8) detected in STEP S52, the relative position (x2, y2) between the reference position P2 and the search reference position R2 detected from the image data is obtained. Subsequently, from the difference between the detected relative position (x2, y2) and the ideal relative position (x2, y2) acquired from the storage device 50, a misalignment amount corresponding to the reference position P2 (the search reference position R2) is derived. Further, from the differences between relative positions (x3, y3) to (x6, y6) obtained from the detection results and the ideal relative positions (x3, y3) to (x6, y6) included in the chart information, misalignment amounts corresponding to the reference positions P3 to P6 (the search reference positions R3 to R6) are derived.

For example, a first chart including four reference positions corresponding to four corners of a paper sheet and two reference positions corresponding to two of the centers between the corners of the paper sheet like the first chart shown in FIG. 7 is suitable to detect general printing-position misalignment of a printable area on a paper sheet.

In this case, if the misalignment amounts corresponding to the reference positions P1 to P6 (the search reference positions R1 to R6) are obtained in the above-mentioned way in STEP S57 of FIG. 10, adjustment according to the misalignment amounts is performed, and then overprinting is performed. For example, printing of the user's images which are print objects based on the printing instruction received from the user are performed as main printing. In other words, printing of the user's images is performed as pre-printing on paper sheets by the printing apparatus 10, and then post-printing is performed on the paper sheets subjected to the pre-printing by the printing apparatus 20. For the main printing, the post-printing position of the printing engine 24 of the printing apparatus 20 is adjusted such that the misalignment amounts derived in STEP S57 are eliminated (such that misalignment is eliminated). Alternatively, for the main printing, according to the misalignment amounts derived in STEP S57, the pre-printing position of the printing engine 14 of the printing apparatus 10 may be adjusted, or both of the printing engines 14 and 24 may be adjusted.

Also, during test printing of pre-printing, printing of a first chart and a user's image which is an object of main printing may be performed as pre-printing, and during test printing of post-printing, printing of a second chart and the user's image may be performed as post-printing. In this case, for example, it is possible to obtain the amount of printing-position misalignment in a printing condition similar to that for main printing.

Although the exemplary embodiment of the present invention has been described above, the above-described exemplary embodiment is merely illustrative in every respect, and does not limit the scope of the present invention. The invention may encompass various modifications within a range which does not depart from the gist thereof.

What is claimed is:

1. A printing apparatus comprising:

a memory storing a program; and at least one hardware processor configured to execute a process in the program, the process comprising:

performing pre-printing of overprinting which is an operation of performing pre-printing on a medium and then performing post-printing on the medium; and printing a chart asymmetric with respect to rotation toward a direction of the medium on the medium during test printing related to the pre-printing, the chart including one or more marks indicating the direction of the medium.

2. The printing apparatus according to claim 1, wherein:

in the one or more marks, a mark having a position indicating the direction of the medium and a mark having a shape indicating the direction of the medium is included.

3. The printing apparatus according to claim 2, wherein:

during the test printing related to the pre-printing, the chart including a plurality of reference marks indicating a plurality of reference positions is printed.

4. The printing apparatus according to claim 1, wherein:

during the test printing related to the pre-printing, the chart including a plurality of reference marks indicating a plurality of reference positions is printed.

5. The printing apparatus according to claim 4, wherein:

in the plurality of reference marks, marks indicating reference positions corresponding to the corners of the medium and/or marks indicating the centers between the corners of the medium are included.

6. The printing apparatus according to claim 5, wherein:

during the test printing related to the pre-printing, the chart including the plurality of reference marks arranged so as to be asymmetric with respect to rotation toward the direction of the medium is printed.

7. The printing apparatus according to claim 4, wherein:

during the test printing related to the pre-printing, the chart including the plurality of reference marks arranged so as to be asymmetric with respect to rotation toward the direction of the medium is printed.

8. The printing apparatus according to claim 1, wherein:

during the test printing related to the pre-printing, the chart including a plurality of reference marks indicating a plurality of reference positions is printed.

9. A printing system for performing overprinting which is an operation of performing pre-printing on a medium and then performing post-printing on the medium, comprising:

a first printing unit that prints a first chart asymmetric with respect to rotation toward a direction of the medium on the medium during test printing related to the pre-printing, the first chart including a first mark indicating the direction of the pre-printing;

a second printing unit that prints a second chart on the medium having the first chart printed on the medium during test printing related to the post-printing, the second chart including a second mark indicating the direction of the post-printing;

a reading unit that reads image data of the first chart and the second chart printed on the medium; and a determining unit that determines whether directions of the pre-printing and the post-printing are correct, from the image data read by the reading unit, by comparing the first mark and the second mark included in the in data.

10. The printing system according to claim 9, wherein:

the first mark is arranged at a position indicating the direction of the pre-printing, the second mark is arranged at a position indicating the direction of the post-printing, and the determining unit determines whether the directions of the pre-printing and the post-printing are correct, from the relationship between the positions of the first mark and the second mark in the image data.

11. The printing system according to claim 10, wherein:

the first mark has a shape indicating the direction of the pre-printing, the second mark has a shape indicating the direction of the post-printing, and the determining unit determines whether the directions of the pre-printing and the post-printing are correct, by comparing the shape of the first mark and the shape of the second mark in the image data.

12. The printing system according to claim 9, wherein:

the first mark has a shape indicating the direction of the pre-printing, the second mark has a shape indicating the direction of the post-printing, and the determining unit determines whether the directions of the pre-printing and the post-printing are correct, by comparing the shape of the first mark and the shape of the second mark in the image data.

13. The printing system according to claim 9, wherein:

the first printing unit prints the first chart including a plurality of reference marks arranged so as to be asymmetric with respect to rotation toward the direction of the medium, and the determining unit determines whether the directions of the pre-printing and the post-printing are correct, from search results of the plurality of reference marks in the image data.

14. The printing system according to claim 13, further comprising:

a searching unit that determines a plurality of search areas from the second chart included in the image data, and searches the plurality of search areas included in the image data for the plurality of reference marks included in the first chart, wherein the determining unit determines whether the directions of the pre-printing and the post-printing are correct, from search results of the plurality of reference marks in the plurality of search areas included in the image data.

15. The printing system according to claim 13, further comprising:

a deriving unit that derives a misalignment amount between a printing position of the pre-printing and a printing position of the post-printing by comparing the relative position relationship between reference positions indicated by the plurality of reference marks included in the first chart included in the image data and search reference positions indicated by the second chart included in the image data and an ideal relative position relationship obtained from the first chart and the second chart.

16. The printing system according to claim 15, wherein: according to the derived misalignment amount, at least one of the printing position of the pre-printing on the medium and the printing position of the post-printing on the medium is adjusted, and the overprinting is performed on the medium.

17. The printing system according to claim 13, wherein: in the plurality of reference marks, at least one of marks indicating reference positions corresponding to the corners of the medium and marks indicating reference positions corresponding to the centers between the corners of the medium are included.

18. A non-transitory computer readable medium storing a program causing a computer to execute a process for printing, the process comprising:

controlling a printing engine such that the printing engine performs pre-printing of overprinting which is an operation of performing pre-printing on a medium and than performing post-printing on the medium; and controlling the printing engine such that the printing engine prints a chart asymmetric with respect to rotation toward a direction of the medium on the medium during test printing related to the pre-printing, the chart including one or more marks indicating the direction of the medium.

* * * * *